US005743806A

United States Patent [19]

Brennan

[11] Patent Number: 5,743,806

[45] Date of Patent: Apr. 28, 1998

[54] GOLF SWING TRAINER

[76] Inventor: Daniel P. Brennan, 7411 Lantana Ter., Carlsbad, Calif. 92009

[21] Appl. No.: 638,362

[22] Filed: Apr. 26, 1996

[51] Int. Cl.[6] ..... A63B 69/36

[52] U.S. Cl. ..... 473/214; 473/276

[58] Field of Search ..... 473/214, 276

[56] References Cited

U.S. PATENT DOCUMENTS

| | | | |
|---|---|---|---|
| 802,623 | 10/1905 | Camp | 473/214 |
| 2,809,042 | 10/1957 | Wasley | 473/214 |
| 3,415,524 | 12/1968 | Vickers | 272/80 |
| 3,900,199 | 8/1975 | McGonagle | 273/189 A |
| 5,048,837 | 9/1991 | Manley et al. | 273/183 |
| 5,108,103 | 4/1992 | Rilling | 273/183 B |
| 5,150,901 | 9/1992 | Stawicki | 273/186.2 |
| 5,203,570 | 4/1993 | Graham | 273/187.2 |
| 5,445,385 | 8/1995 | Brooks | 273/189 A |

*Primary Examiner*—George J. Marlo
*Attorney, Agent, or Firm*—Arthur F. Holz

[57] ABSTRACT

A training device for golfers consists of a flexible fabric sleeve and a pocket containing a lengthwise concave metallic strip positioned at the outside of the players elbow on the leading arm of the player (left arm for right handed player). Positioning the strip to the outside of the radius of flexion of the joint and over the bony protrusion of the ulna (the olecranon) as a fulcrum causes the strip to audibly deform at a small and precise degree of movement of the joint. The sleeve does not restrict flexion of the elbow, but since a straight arm non-flexed position of the arm is desirably maintained from the backswing and to the follow through, any flexion will cause the metallic strip to audibly emit a clicking sound, alerting the player to erroneous form.

12 Claims, 2 Drawing Sheets

GOLF SWING TRAINER

FIELD OF THE INVENTION

This invention relates to the art of sports training devices and more particularly to a golf swing training device which teaches a golfer to maintain full extension of the golfer's leading arm during the golf swing.

BACKGROUND OF THE INVENTION

An almost universal problem in proper execution of the athletic task of striking a golf ball with a golf club is maintaining correct arm position throughout the golf swing. The golfer's posture and positioning of arms, legs, head, shoulders, feet and hips in various stages of the golf swing including address, back swing, stroke, and follow through are critical and complex, and most golfers find the perfection of the swing to be a life long learning experience which can always be tuned and improved. Among the many components of a golf swing, and one that offers particular difficulty especially for the beginning golfer is maintaining an essentially extended position of the leading arm (left arm for a right handed player) it is generally acknowledged that the leading arm should be maintained fully extended in the address, backswing and stroke phases of the swing and would only be bent as the golfer's body turns into the follow through of the swing. If the leading arm is erroneously allowed to bend or flex at the apex of the backswing, the stroke itself will be adversely affected and the arc of the player's hands and the golf club itself will follow an irregular path. Conversely, by correctly maintaining an extended or stiff extension of the leading arm in the stroke will maximize the club head arc and more nearly follow an ideal circular path up to the point of follow through. One reason for the common experience of difficulty in maintaining this simple instruction is that the body is twisted from the hips into the backswing and the shoulders must be rotated into the backswing in order to maintain a stiff leading arm. The temptation is to relax the full turn of the shoulders and bend the leading elbow to withdraw the club head further up into the backswing, which as described before, will adversely affect the path of the player's hands and the golf club head as the swing is commenced.

It would be desirable to execute an idealized form of golf swing as much as possible. A player's skill at the game depends on a consistent execution of the many difficult parts of a golf swing and maintaining that consistency throughout the varying conditions of terrain, selectible golf club length and other variables presented to the player during the progress through the course of the game. While it is true that perfection can only come through practice, both on the golf course, on the training range and in other training environments, it is also recognized that various teaching and training aids may assist the player in achieving consistency and accelerate the learning process. One such device is illustrated in U.S. Pat. No. 5,445,385 to Brooks for a golf training device which is a rigidifying sleeve that surrounds the leading arm from wrist to bicep and forces the elbow to remain stiff and fully extended throughout the golf swing. While this class of device can achieve the desired extension of the left arm, it undesirably restrains the arm from allowable and proper bending in the follow through and, worse, can actually bruise or cause pain to the player as the restraint acts against muscle and skin tissues as the restraint takes effect during the swing. Even more to the point, a restraint device does little to actually train the player to correctly make the same maneuver without the restraint. In the case at hand the golfer's elbow will bend during a swing in which he is not wearing the restraint, as restraint is its primary function rather than training to operate without the restraint.

DESCRIPTION OF THE RELATED ART

Other devices of the prior art provide similar restraints with the same disadvantages as U.S. Pat. No. 5,445,385, such as U.S. Pat. No. 5,203,570 to Graham, another inflexible restraint applied to the player's leading arm. U.S. Pat. No. 3,900,199 to McGonagle similarly discloses a rigid elbow brace which will not allow any flexion of the leading arm and is ineffective for training purposes when removed.

The approach of the instant invention is to provide a moderate restraining influence against flexion of the leading arm during the golf swing but to allow flexion as the modest restraint may be overcome. Its effectiveness as a training aid rather than pure restraint is provided by a warning device which audibly alerts the player to the fact that his elbow has improperly flexed during the golf swing. Thus the effect of operation of the device is that the player is encouraged during training to voluntarily maintain the correct arm position during the swing without being physically restrained, with the end result that when the training device is removed the golfer will remember the effective repetitive movement, either consciously or as a matter of "feel" (which is also known in sports training circles as "muscle memory").

Thus it is an objective of the within invention to provide a golf training device that will teach proper position of the golfer's left arm during the swing without artificially restraining movement.

Another objective of the invention is to provide a reliable audible signal to the golfer if during the golf swing the left arm should flex to an improper or non ideal position.

Still further objective of the invention is to provide an effective training device that may either be removed or worn during actual course play.

Another object of the invention is to enable the golf training device to be reliably operated with no moving parts.

A final object of the invention is to provide a golf training device that minimizes difficulty of use or restraint of the user while maintaining its effectiveness as a teaching aid.

BRIEF SUMMARY OF THE INVENTION

The golf swing training device of the instant invention is a simple fabric sleeve retained above and below the elbow of the golfer's leading arm by straps with suitable fastening means. The operative component of the device as a training aid is a semi-rigid strip of metal, plastic or other suitable material contained within a sewn pocket by the fabric sleeve and positioned with its mid point over the point of the elbow and extending longitudinally from the forearm to the upper arm across the elbow. While the user's forearm is fully extended the semi-rigid strip is not disturbed, but at the point that the elbow is bent the outer extended bone of the elbow will press against the semi-rigid strip causing the strip to deform and emit an audible warning sound. The sound is typically perceived as a "click" and is an instantaneous warning feedback signal to the player that his stroke has deviated from the ideal position at any time during the address, backswing and stroke. Further, at the point of progress in the stroke, after the ball is struck and the player's wrists flex (commonly known as the point of "wrist break") and the player enters the follow through of the swing, the club moves over the leading shoulder and proper form allows the leading arm to flex and the elbow to bend. Thus through most of the swing the audible warning click is an indicator of improper swing and at the conclusion of the swing in the follow through a permissible click is heard. The expectation of hearing the click at the proper time in the follow through additionally improves the players perception of timing throughout the swing which is concluded with the final click.

Thus the objectives of the invention stated above are met completely by a comfortable, flexible, non-restraining golf training device that gives instantaneous non-interfering feedback to the player of proper position throughout the golf swing.

DETAILED DESCRIPTION OF THE INVENTION

Figure 1:
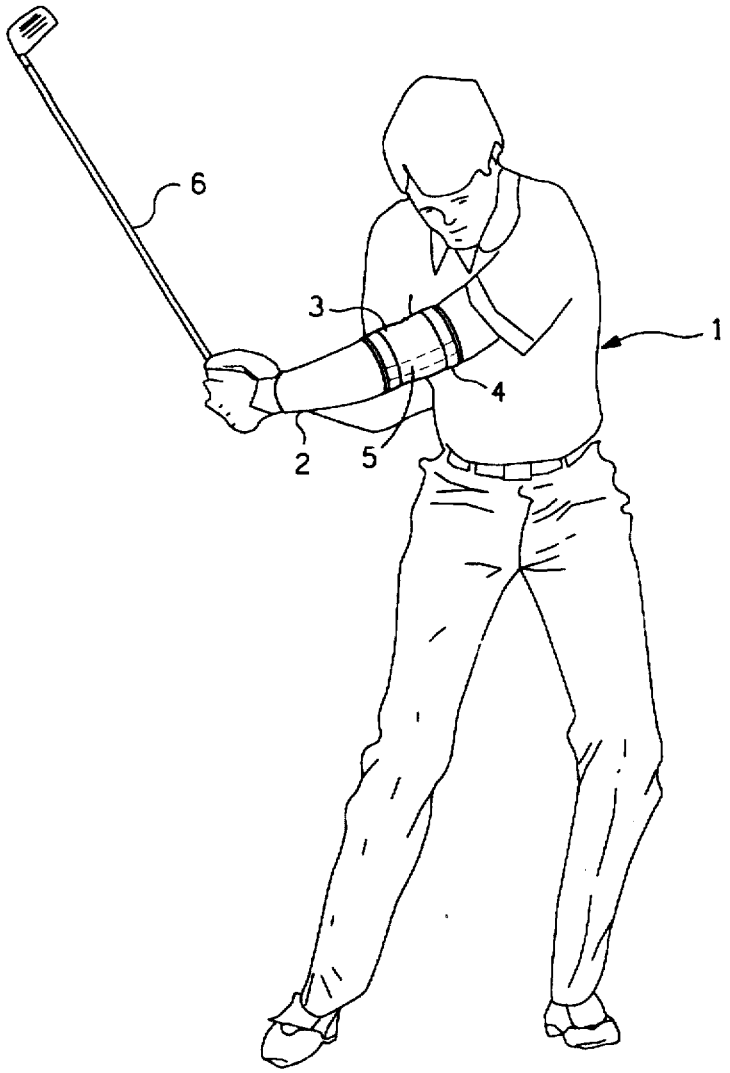
FIG. 1 is a perspective view of a golfer with the present invention in place on the golfers leading arm at a position of completion of the backswing and commencement of the stroke.

While the invention described herein is adaptable to different forms of embodiment, the device shown in the drawings and herein described in detail is the preferred embodiment of the invention and is applied to the primary contextual environment. However it should also be understood that the present disclosure is to be considered an exemplification of the principals of the invention and is not intended to limit the invention to the embodiment illustrated, which may be applied in other contexts and sporting environments as well.

Referring now to FIG. 1, a right handed male golfer 1 is shown during the progress of a golf swing and wearing on his left or leading arm 2 the fabric sleeve 3 which is the primary component of the instant invention as a training aid. The device is further shown to include restraining bands 4, and, shown in hidden view, a longitudinally disposed pocket 5 which contains a semi-rigid strip of deformable material as described below. The golfer is shown swinging a club 6, shown here as an iron but which could be any length or style of club; the iron is raised into the backswing position and the swing has just commenced. It can be clearly seen in this view that the golfer's leading arm is in an extended position which is the proper position to maintain from the time that the ball is first addressed up into the backswing position and as the club is swung down into the stroke. This extended, unflexed position must be maintained throughout the stroke until the final follow through at which time the club has completed the arc of its swing all the way up to the forward shoulder level position where the swing is completed by a follow through motion in which the shoulders are turned forward and the club head is drawn back behind the player's head. Only at the follow through position may the elbow of the leading arm be bent, because only by keeping the left arm fully extended throughout the stroke can the essentially circular path of the club head arc be achieved, and thereby achieving maximum club head speed and accuracy as the club strikes the ball.

Figure 2:
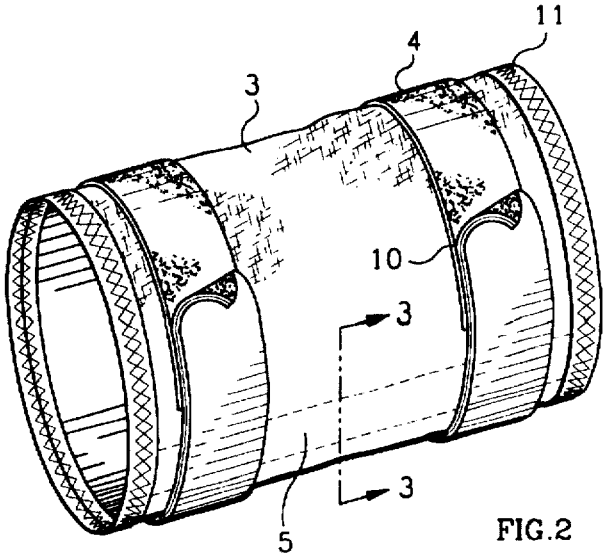
FIG. 2 is an enlarged perspective view of the sleeve device showing its major components.

FIG. 2 illustrates in perspective view the device itself, consisting principally of a flexible fabric sleeve 3 and retaining straps 4 at either end of the sleeve such that when applied one strap will be below the elbow and one strap above. Each strap is wrapped around the user's arm and includes suitable fastening means 10 which may either be a pair of mating hook-and-loop fabric closures (such as Velcro brand) or a snap or buckle. The sleeve is comfortably banded at the openings by sewn cuffs 11.

The operative component of the Golf Training Device is shown in FIG. 2 as a hidden view of a fabric pocket within the sleeve extending longitudinally and containing, as will be shown in more detail in a later view, a deformable semi-rigid strip of material which, while only restraining flexion of the elbow in slight effect, will allow the elbow to be bent but signal this undesirable movement by emitting an audible sound as the strip is deformed. Thus the training effect of wearing the device is accomplished by giving the player an immediate audible "click" sound at the instant that the elbow is bent. Of course the strip must be placed over the point of the elbow that protrudes when the elbow is in bent or flexed position, which is a familiar bony point is known anatomically as the olecranon process. While the outer surface of the elbow is essentially flat and has no significant protrusion when the arm is in the fully extended position, the olecranon process will extend almost immediately as the flexion of the arm and bending of the elbow begins. In the present invention, the protrusion of the olecranon process will press directly against the center of the retained strip within the training device sleeve and deform the semi-rigid metallic or plastic strip, producing an audible sound.

Figure 3A:
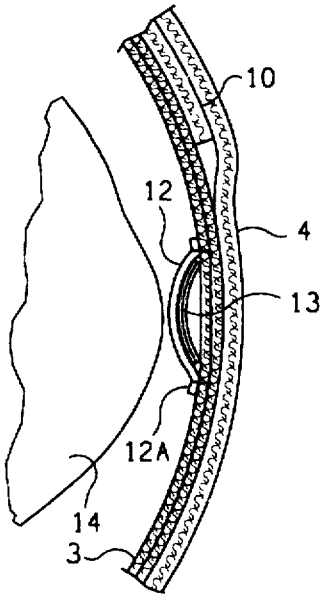
FIG. 3A is a partial section view along line 3—3 of FIG. 2 of the sleeve device in place in proximity of the player's elbow.

The described operation of the device may be more clearly seen in FIG. 3A which shows a partial cross-section of the sleeve construction of the device along section line 3—3 of FIG. 2. FIG. 3A again shows the fabric shell of the sleeve 3, the retaining strap 4 and the closure device 10 at the ends of the strap. Also more clearly seen in this cross-sectional view is fabric retaining pocket 12 with stitch points 12A which secure the lengthwise pocket to the inside of the fabric sleeve 3. Contained within the lengthwise pocket is an elongate semi-rigid strip 13 composed of material that will be essentially rigid in its extended position but easily deformed to a bent position. Note especially that the strip is concave to the outside of the sleeve and is positioned in close proximity to the representational cross-section of the player's arm 14. In this undeformed position the device passively resides on the player's arm, but at the point that the arm erroneously is bent at any time during the golf swing, the protrusion of the elbow will press against the center of deformable strip 13.

Figure 3B:
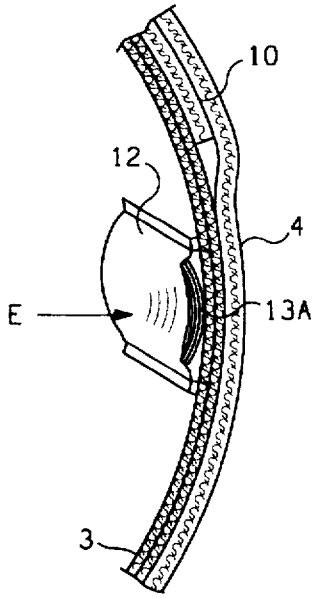
FIG. 3B is a cross section of the same view as FIG. 3A showing the device having been actuated to produce a warning audible signal.

FIG. 3B illustrates the effect of the deformation of the metallic strip which is shown in FIG. 3B in position 13A as the deformation of the strip has caused it to snap from being concave to the outside to being convex in that direction. Note that the pressure against the strip in direction of arrow E as the elbow is pressed against the strip bends the entire metallic strip and moves the plane of the pocket 12 containing the strip. As the strip is thus moved from concave to convex configuration it will emit an audible sound generally perceived as a "click".

Figure 4:
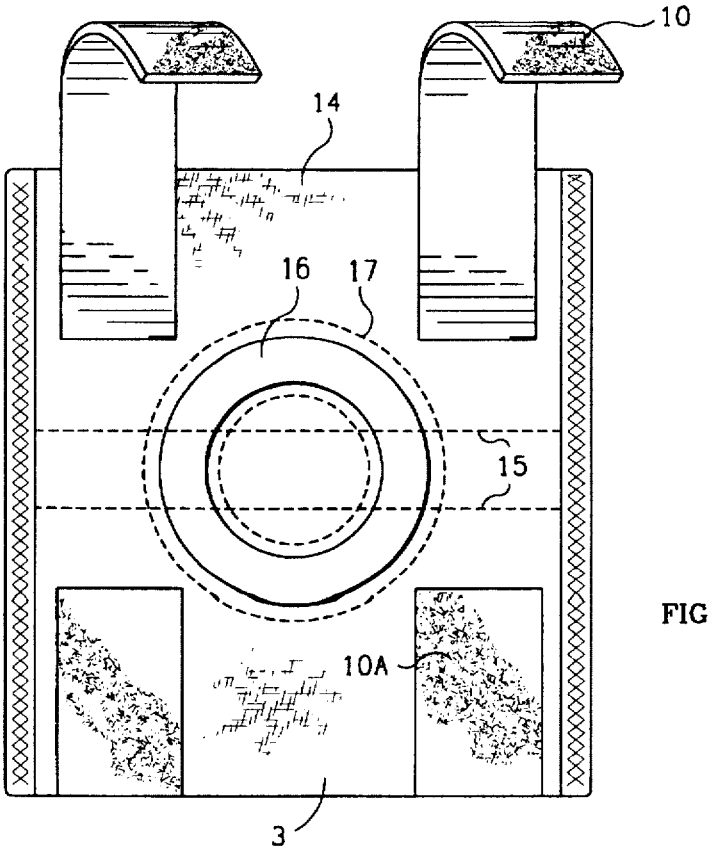
FIG. 4 is an open spread view of the fabric sleeve device showing an optional positioning component.

FIG. 4 further illustrates typical configuration of the device and an optional feature. In FIG. 4 the fabric sleeve 3 is shown in a flattened position which illustrated its construction as a flat expanse 14 of the fabric material banded at its ends by cuffs 11, and with retaining bands 4 affixed to the outer surface of the material, each band including termini 10 and 10A which further comprise fastening means. Thus cylindrical form of the device illustrated in FIG. 2 is achieved by wrapping the flat expanse around the use's arm and securing it by the retaining straps. FIG. 4 also illustrates the positioning of the retaining pocket for the metallic strip as it is defined by stitching lines 15. While the device could be constructed as a closed cylinder, the flat wrap configuration is most convenient, simplified and economical of manufacture.

FIG. 4 also illustrates an additional feature consisting of elbow positioning cup 16, a "doughnut" of padded material within another inside pocket formed of cup outer stitching circles 17 and cup inner stitching circle 18. The padded raised surface provided by the elbow positioning cup serves to accurately and securely maintain the center position of the deformable metallic strip over the protruding bone of the player's elbow in flexed or extended position.

Thus it may be seen that the preferred embodiment of the invention accomplishes its stated objectives in a convenient, inexpensive and effective manner. Additionally the device is comfortable in wear and usage, can be worn exposed, underneath or even over clothing, is unobtrusive and will not disturb or distract other players and may be worn during actual play as well as during training or practice. Further the device may be also adapted to other sports training environments where an audible signal that contributes to training and muscle memory without undue actual physical restraint can be advantageously employed. For instance to train a player to recognize specific flexion points during the swinging motion in tennis or other racquet sports could be desirable, and the device could conceivably be used for training in industrial or operational context for training of precise repetitive movements. In any of these applications the deformable semi-rigid strip need only be positioned over a flexing joint, such that movement of the joint into an undesired position would produce deformation of the strip and the audible clicking should to alert the user/trainee of the movement.

Having described the invention, I claim:

1. An improved swing training device for a golf player including a strip of semi-rigid spring material that will emit an audible sound when bent and means to secure the opposite ends of said strip to the player's arm above and below the elbow, the improvement comprising:

a sleeve configured to encircle the player's arm and fit securely over one elbow of the player throughout the swing, retaining means within said sleeve to hold and position said strip parallel to the player's arm and centered over the outside of the player's elbow such that the protrusion of the olecranon is a fulcrum at the approximate center of said strip.

2. The device of claim 1 wherein said sleeve is comprised of a fabric tube.

3. The device of claim 1 wherein said semi-rigid strip of material is a metallic strip, concave across its shorter dimension and positioned within said retaining means such that the concave surface is oriented toward the outside of said sleeve.

4. The device of claim 1 wherein said semi-rigid strip of material is a plastic strip, concave across its shorter dimension and positioned within said retaining means such that the concave surface is oriented toward the outside of said sleeve.

5. The device of claim 1 wherein said retaining means for said strip is a fabric pocket disposed longitudinally with respect to said sleeve.

6. The device of claim 1 further comprising a positioning ridge in the interior of said sleeve.

7. The device of claim 6 where said positioning ridge further comprises a toroidal pocket and filler material within said pocket to produce a ridged cup for positioning over the player's elbow.

8. The device of claim 1 further including a plurality of straps to secure said sleeve in position on the players arm above and below the player's elbow.

9. The device of claim 8 wherein said straps include closure means.

10. The device of claim 9 wherein said closure means are mating hook and loop fastener surfaces.

11. The device of claim 9 wherein said closure means are buckles.

12. The device of claim 9 wherein said closure means are snaps.

* * * * *